US011749205B2

(12) United States Patent
Lee et al.

(10) Patent No.: US 11,749,205 B2
(45) Date of Patent: Sep. 5, 2023

(54) GATE DRIVING CIRCUIT HAVING A DUMMY PULL-DOWN TRANSISTOR TO SENSE CURRENT AND DRIVING METHOD THEREOF

(71) Applicant: LG Display Co., Ltd., Seoul (KR)

(72) Inventors: HaeSeung Lee, Seoul (KR); MooKyoung Hong, Paju-si (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 17/549,552

(22) Filed: Dec. 13, 2021

(65) Prior Publication Data

US 2022/0208108 A1 Jun. 30, 2022

(30) Foreign Application Priority Data

Dec. 30, 2020 (KR) ..... 10-2020-0187255

(51) Int. Cl.
*G09G 3/3266* (2016.01)

(52) U.S. Cl.
CPC ..... *G09G 3/3266* (2013.01); *G09G 2310/027* (2013.01); *G09G 2310/0291* (2013.01)

(58) Field of Classification Search
CPC ..... G09G 3/3266
USPC ..... 345/204
See application file for complete search history.

(56) References Cited

U.S. PATENT DOCUMENTS

| | | | | |
|---|---|---|---|---|
| 9,940,889 | B2 | 4/2018 | Park et al. | |
| 10,198,987 | B2 | 2/2019 | Shim et al. | |
| 11,081,061 | B2 | 8/2021 | Feng et al. | |
| 2014/0225882 | A1* | 8/2014 | Wu | G09G 3/20 345/212 |
| 2016/0365052 | A1 | 12/2016 | Park et al. | |
| 2018/0096645 | A1* | 4/2018 | Lee | G09G 3/20 |
| 2018/0174503 | A1 | 6/2018 | Shim et al. | |
| 2019/0244578 | A1* | 8/2019 | Wu | G06F 3/0416 |
| 2021/0065630 | A1 | 3/2021 | Feng et al. | |

FOREIGN PATENT DOCUMENTS

| | | | |
|---|---|---|---|
| CN | 110942742 | B | 5/2020 |
| KR | 10-2016-0148131 | A | 12/2016 |
| KR | 10-2018-0070997 | A | 6/2018 |
| KR | 10-2019-0075640 | A | 7/2019 |
| WO | WO 2020/024985 | A1 | 2/2020 |

* cited by examiner

*Primary Examiner* — Long D Pham
(74) *Attorney, Agent, or Firm* — Fenwick & West LLP

(57) ABSTRACT

A display device is provided that includes a display panel including one or more sub-pixels and a gate driving circuit supplying a gate signal to the sub-pixels through gate lines, the gate driving circuit including a gate output buffer circuit including a pull-up transistor that controls a connection between a clock input node and a gate output node, and a pull-down transistor that controls a connection between a low level voltage node and the gate output node, a control circuit capable of controlling the gate output buffer circuit, and a dummy pull-down transistor whose a gate node is shared with a gate node of the pull-down transistor.

16 Claims, 10 Drawing Sheets

GATE DRIVING CIRCUIT HAVING A DUMMY PULL-DOWN TRANSISTOR TO SENSE CURRENT AND DRIVING METHOD THEREOF

CROSS-REFERENCE TO RELATED APPLICATION

This application claims the priority benefit Republic of Korea Patent Application No. 10-2020-0187255, filed on Dec. 30, 2020 in the Korean Intellectual Property Office, the disclosure of which is incorporated herein by reference in its entirety.

BACKGROUND

Field of the Disclosure

The present disclosure relates to touch driving circuits and touch display devices.

Description of the Background

As the advent of information society, there have been growing needs for display devices for displaying images. To meet such needs, recently, various types of display devices, such as a Liquid Crystal Display (LCD) device, an Electroluminescence Display (ELD) device including a Quantum-dot Light Emitting Display device, and an Organic Light Emitting Display (e.g., OLED) device, and the like, have been developed and widely used.

In typical display devices, as a size of the non-display area of a display panel therein is reduced, design freedom of the display device can be increased and design quality can be improved. However, since various lines and circuit elements are arranged in the non-display area of the display panel, in reality, it is not easy to reduce the size of the non-display area of the display panel.

SUMMARY

Embodiments of the present disclosure provide a gate driving circuit capable of reducing the number of transistors included in the gate driving circuit and reducing the complexity of circuitry or circuit elements configured in the gate driving circuit, and a display device including the gate driving circuit.

Embodiments of the present disclosure provide a gate driving circuit capable of reducing a defect rate of the gate driving circuit and allowing a narrow bezel to be implemented, and a display device including the gate driving circuit.

Embodiments of the present disclosure provide a gate driving circuit capable of maximizing or increasing the lifetime of a transistor included in the gate driving circuit, and a display device including the gate driving circuit.

According to aspects of the present disclosure, a display device is provided that includes a display panel including at least one sub-pixel and a gate driving circuit supplying a gate signal to the at least one sub-pixel through at least one gate line.

The gate driving circuit includes a gate output buffer circuit including a pull-up transistor that controls a connection between a clock input node and a gate output node, and a pull-down transistor that controls a connection between a low level voltage node and the gate output node, a control circuit that controls the gate output buffer circuit, and a dummy pull-down transistor whose a gate node is shared with a gate node of the pull-down transistor.

In another embodiment, a display device comprising a display panel including at least one sub-pixel; and a gate driving circuit configured to supply a gate signal to the at least one sub-pixel through at least one gate line. The gate driving circuit comprises a gate output buffer circuit configured to output the gate signal to the at least one gate line, the gate output buffer including a pull-up transistor configured to output a clock signal as the gate signal to the at least one gate line when the pull-up transistor is turned on, a pull-down transistor configured to output a low level voltage to the at least one gate line when the pull-down transistor is turned on, a dummy pull-down transistor, the dummy pull-down transistor turned on while the pull-down transistor is turned on, and the dummy pull-down transistor turned off while the pull-down transistor is turned off.

According to embodiments of the present disclosure, it is possible to provide the gate driving circuit capable of reducing the number of transistors included in the gate driving circuit and reducing the complexity of circuitry or circuit elements configured in the gate driving circuit, and the display device including the gate driving circuit.

Thereby, it is possible to provide the gate driving circuit capable of reducing a defect rate of the gate driving circuit and allowing a narrow bezel to be implemented, and the display device including the gate driving circuit.

Further, according to embodiments of the present disclosure, it is possible to provide the gate driving circuit capable of maximizing or increasing the lifetime of a transistor included in the gate driving circuit by adjusting the stress of the transistor, and the display device including the gate driving circuit.

BRIEF DESCRIPTION OF THE DRAWINGS

The accompanying drawings, which are included to provide a further understanding of the disclosure and are incorporated in and constitute a part of the disclosure, illustrate aspects of the disclosure and together with the description serve to explain the principle of the disclosure. In the drawings.

DETAILED DESCRIPTION

Figure 1:
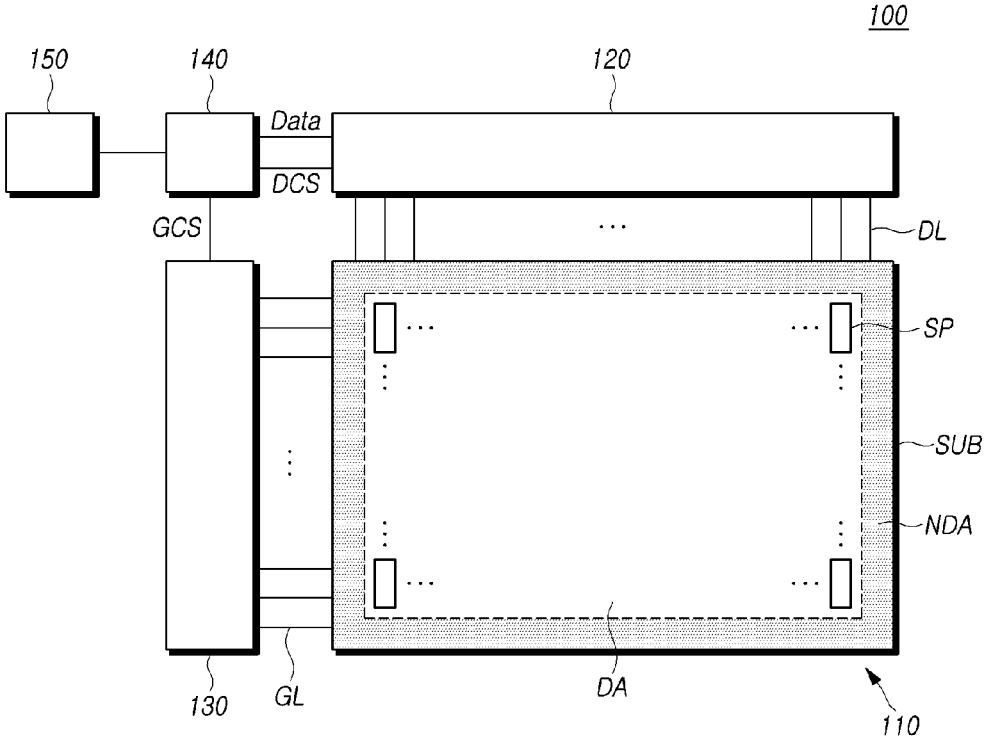
FIG. 1 illustrates a system configuration of a display device according to aspects of the present disclosure.

In the following description of examples or embodiments of the present disclosure, reference will be made to the accompanying drawings in which it is shown by way of illustration specific examples or embodiments that can be implemented, and in which the same reference numerals and signs can be used to designate the same or like components even when they are shown in different accompanying drawings from one another. Further, in the following description of examples or embodiments of the present disclosure, detailed descriptions of well-known functions and components incorporated herein will be omitted when it is determined that the description may make the subject matter in some embodiments of the present disclosure rather unclear. The terms such as "including", "having", "containing", "constituting" "make up of", and "formed of" used herein are generally intended to allow other components to be added unless the terms are used with the term "only". As used herein, singular forms are intended to include plural forms unless the context clearly indicates otherwise.

Terms, such as "first", "second", "A", "B", "(A)", or "(B)" may be used herein to describe elements of the present disclosure. Each of these terms is not used to define essence, order, sequence, or number of elements etc., but is used merely to distinguish the corresponding element from other elements.

When it is mentioned that a first element "is connected or coupled to", "contacts or overlaps" etc. a second element, it should be interpreted that, not only can the first element "be directly connected or coupled to" or "directly contact or overlap" the second element, but a third element can also be "interposed" between the first and second elements, or the first and second elements can "be connected or coupled to", "contact or overlap", etc. each other via a fourth element. Here, the second element may be included in at least one of two or more elements that "are connected or coupled to", "contact or overlap", etc. each other.

When time relative terms, such as "after," "subsequent to," "next," "before," and the like, are used to describe processes or operations of elements or configurations, or flows or steps in operating, processing, manufacturing methods, these terms may be used to describe non-consecutive or non-sequential processes or operations unless the term "directly" or "immediately" is used together.

In addition, when any dimensions, relative sizes etc. are mentioned, it should be considered that numerical values for an elements or features, or corresponding information (e.g., level, range, etc.) include a tolerance or error range that may be caused by various factors (e.g., process factors, internal or external impact, noise, etc.) even when a relevant description is not specified. Further, the term "may" fully encompasses all the meanings of the term "can".

FIG. 1 illustrates a system configuration of a display device 100 according to aspects of the present disclosure.

Referring to FIG. 1, the display device 100 according to aspects of the present disclosure can include a display panel 110 and driving circuits (120, 130, and 140) for driving the display panel 110.

The driving circuits may include a data driving circuit 120, a gate driving circuit 130, and the like, and may further include a controller 140 that controls the data driving circuit 120 and the gate driving circuit 130.

The display panel 110 may include a substrate SUB, and signal lines such as a plurality of data lines DL, a plurality of gate lines GL, and the like disposed over the substrate SUB. The display panel 110 may include a plurality of sub-pixels SP connected to the plurality of gate lines GL and the plurality of data lines DL.

The display panel 110 may include a display area DA in which an image is displayed and a non-display area NDA in which an image is not displayed. The plurality of sub-pixels SP for displaying images may be disposed in the display area DA of the display panel 110, and the driving circuits (120, 130, and 140) may be electrically connected to, or mounted in, the non-display area NDA of the display panel 110. Further, a pad portion to which an integrated circuit, a printed circuit, and/or the like are connected may be disposed in the non-display area NDA.

The data driving circuit 120 is a circuit for driving the plurality of data lines DL, and can supply data signals to the plurality of data lines DL.

The gate driving circuit 130 is a circuit for driving the plurality of gate lines GL, and can supply gate signals to the plurality of gate lines GL.

The controller 140 can supply a data control signal DCS to the data driving circuit 120 in order to control an operation timing of the data driving circuit 120. The controller 140 can supply a gate control signal GCS to the gate driving circuit 130 in order to control an operation timing of the gate driving circuit 130.

The controller 140 starts a scanning operation according to timings scheduled in each frame, converts image data inputted from other devices or other image providing sources to a data signal form used in the data driving circuit 120 and then supplies image data Data resulting from the converting to the data driving circuit 120, and controls the loading of the data to at least one pixel at a pre-configured time according to a scan timing.

The controller 140 can receive, in addition to input image data, several types of timing signals including a vertical synchronous signal VSYNC, a horizontal synchronous signal HSYNC, an input data enable signal DE, a clock signal CLK, and the like from other devices, networks, or systems (e.g., a host system 150).

In order to control the data driving circuit 120 and the gate driving circuit 130, the controller 140 can receive one or more of the timing signals such as the vertical synchronization signal VSYNC, the horizontal synchronization signal HSYNC, the input data enable signal DE, the clock signal CLK, and the like, generate several types of control signals DCS and GCS, and output the generated signals to the data driving circuit 120 and the gate driving circuit 130.

For example, in order to control the gate driving circuit 130, the controller 140 can output several types of gate control signals GCS including a gate start pulse GSP, a gate shift clock GSC, a gate output enable signal GOE, and the like.

Further, to control the data driving circuit 120, the controller 140 can output several types of data control signals DCS including a source start pulse SSP, a source sampling clock SSC, a source output enable (SOE) signal, and the like.

The controller 140 may be implemented in a separate component from the data driving circuit 120, or integrated with the data driving circuit 120 and implemented into an integrated circuit.

The data driving circuit 120 can drive a plurality of data lines DL by receiving image data Data from the controller 140 and supplying data voltages to the plurality of data lines DL. Here, the data driving circuit 120 may also be referred to as a source driving circuit.

The data driving circuit 120 may include one or more source driver integrated circuits SDICs.

Each source driver integrated circuit SDIC may include a shift register, a latch circuit, a digital-to-analog converter DAC, an output buffer, and the like. In some instances, each source driver integrated circuit SDIC may further include an analog to digital converter ADC.

In some embodiments, each source driver integrated circuit SDIC may be connected to the display panel 110 in a tape automated bonding (TAB) type, or connected to a conductive pad such as a bonding pad of the display panel 110 in a chip on glass (COG) type or a chip on panel (COP) type, or connected to the display panel 110 in a chip on film (COF) type.

The gate driving circuit 130 can output a gate signal of a turn-on level voltage or a gate signal of a turn-off level voltage according to the control of the controller 140. The gate driving circuit 130 can sequentially drive a plurality of gate lines GL by sequentially supplying the gate signals of the turn-on level voltage to the plurality of gate lines GL.

In some embodiments, the gate driving circuit 130 may be connected to the display panel 110 in the tape automated bonding (TAB) type, or connected to a conductive pad such as a bonding pad of the display panel 110 in the chip on glass (COG) type or the chip on panel (COP) type, or connected to the display panel 110 in the chip on film (COF) type. In another embodiment, the gate driving circuit 130 may be disposed in the non-display area NDA of the display panel 110 in a gate in panel (GIP) type. The gate driving circuit 130 may be disposed on or over a substrate SUB, or connected to the substrate SUB. That is, in the case of the GIP type, the gate driving circuit 130 may be disposed in the non-display area NDA of the substrate SUB. The gate driving circuit 130 may be connected to the substrate SUB in the case of the chip on glass (COG) type, the chip on film (COF) type, or the like.

When a specific gate line is driven by the gate driving circuit 130, the data driving circuit 120 can convert image data Data received from the controller 140 into data voltages in an analog form and supply the data voltages resulting from the converting to a plurality of data lines DL.

The data driving circuit 120 may be located on, but not limited to, only one portion (e.g., an upper portion or a lower portion) of the display panel 110. In some embodiments, the data driving circuit 120 may be located on, but not limited to, two portions (e.g., an upper portion and a lower portion) of the panel 110 or at least two of four portions (e.g., the upper portion, the lower portion, a left side, and a right side) of the panel 110 according to driving schemes, panel design schemes, or the like.

The gate driving circuit 130 may be located on, but not limited to, only one portion (e.g., a left side or a right side) of the display panel 110. In some embodiments, the gate driving circuit 130 may be located on, but not limited to, two portions (e.g., a left side and a right side) of the panel 110 or at least two of four portions (e.g., an upper portion, a lower portion, the left side, and the right side) of the panel 110 according to driving schemes, panel design schemes, or the like.

The controller 140 may be a timing controller used in the typical display technology or a control apparatus/device capable of additionally performing other control functionalities in addition to the typical function of the timing controller. In some embodiments, the controller 140 may be one or more other control circuits different from the timing controller, or a circuit or component in the control apparatus/device The controller 140 may be implemented using various circuits or electronic components such as an integrated circuit (IC), a field programmable gate array (FPGA), an application specific integrated circuit (ASIC), a processor, and/or the like.

The controller 140 may be mounted on a printed circuit board, a flexible printed circuit, or the like, and may be electrically connected to the data driving circuit 120 and the gate driving circuit 130 through the printed circuit board, the flexible printed circuit, or the like.

The controller 140 may transmit signals to, and receive signals from, the data driving circuit 120 via one or more predetermined interfaces. In some embodiments, such interfaces may include a low voltage differential signaling (LVDS) interface, an EPI interface, a serial peripheral interface (SPI), and the like.

The controller 140 may include a storage medium such as one or more registers.

The display device 100 according to aspects of the present disclosure may be a display including a backlight unit such as a liquid crystal display device, or may be a self-emissive display such as an organic light emitting diode (OLED) display, a quantum dot (QD) display, a micro light emitting diode (M-LED) display, and the like.

In case the display device 100 according to aspects of the present disclosure is the OLED display, each sub-pixel SP may include an OLED where the OLED itself emits light as a light emitting element. In case the display device 100 according to aspects of the present disclosure is the QD display, each sub-pixel SP may include a light emitting element including a quantum dot, which is a self-emissive semiconductor crystal. In case the display device 100 according to aspects of the present disclosure is the micro LED display, each sub-pixel SP may include a micro LED where the micro OLED itself emits light and which is based on an inorganic material as a light emitting element.

Figure 2:
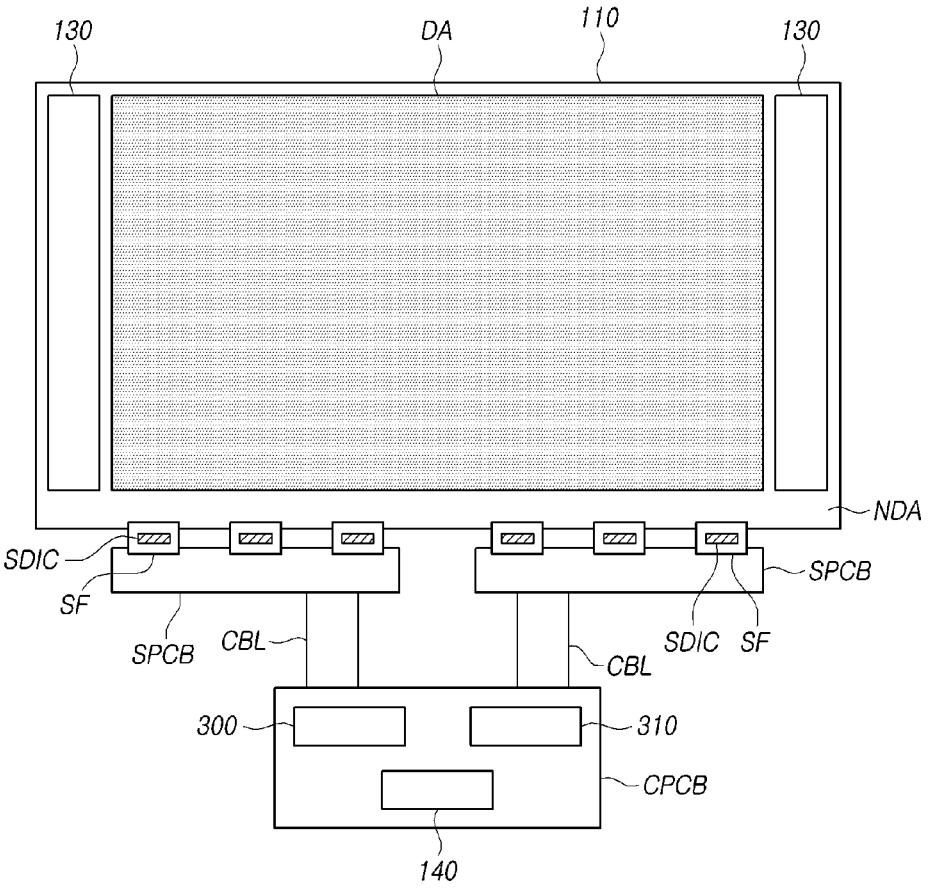
FIG. 2 illustrates an example system implementation of the display device according to aspects of the present disclosure.

FIG. 2 illustrates an example system implementation of the display device according to aspects of the present disclosure.

Referring to FIG. 2, the display panel 110 may include a display area DA in which an image is displayed and a non-display area NDA in which an image is not displayed.

When the data driving circuit 120 includes one or more source driver integrated circuits SDIC and is implemented in the chip on film (COF) type, each source driver integrated circuit SDIC may be mounted on a circuit film SF connected to the non-display area NDA of the display panel 110.

The gate driving circuit 130 may be implemented in the gate in panel (GIP) type. In this embodiment, the gate driving circuit 130 may be disposed in the non-display area NDA of the display panel 110. In another embodiment, unlike the illustration in FIG. 2, the gate driving circuit 130 may be implemented in the chip on film (COF) type.

The display device 100 may include at least one source printed circuit board SPCB for a circuital connection between one or more source driver integrated circuits SDIC and other devices, components, and the like, and a control printed circuit board CPCB on which control components, and various types of electrical devices or components are mounted.

The circuit film SF on which the source driver integrated circuit SDIC is mounted may be connected to at least one source printed circuit board SPCB. That is, one side of the circuit film SF on which the source driver integrated circuit SDIC is mounted may be electrically connected to the display panel 110 and the other side thereof may be electrically connected to the source printed circuit board SPCB.

The controller 140 and a power management integrated circuit 310 may be mounted on the control printed circuit board CPCB. The controller 140 can perform an overall control function related to the driving of the display panel 110 and control operations of the data driving circuit 120 and the gate driving circuit 130. The power management integrated circuit 310 can supply various types of voltages or currents to the data driving circuit 120 and the gate driving circuit 130 or control various types of voltages or currents to be supplied.

A circuital connection between at least one source printed circuit board SPCB and the control printed circuit board CPCB may be performed through at least one connection cable CBL. The connection cable CBL may be, for example, a flexible printed circuit FPC, a flexible flat cable FFC, or the like.

At least one source printed circuit board SPCB and the control printed circuit board CPCB may be integrated and implemented into one printed circuit board.

The display device 100 according to aspects of the present disclosure may further include a level shifter 300 for adjusting a voltage level. In an embodiment, the level shifter 300 may be disposed on the control printed circuit board CPCB or the source printed circuit board SPCB.

Figure 3:
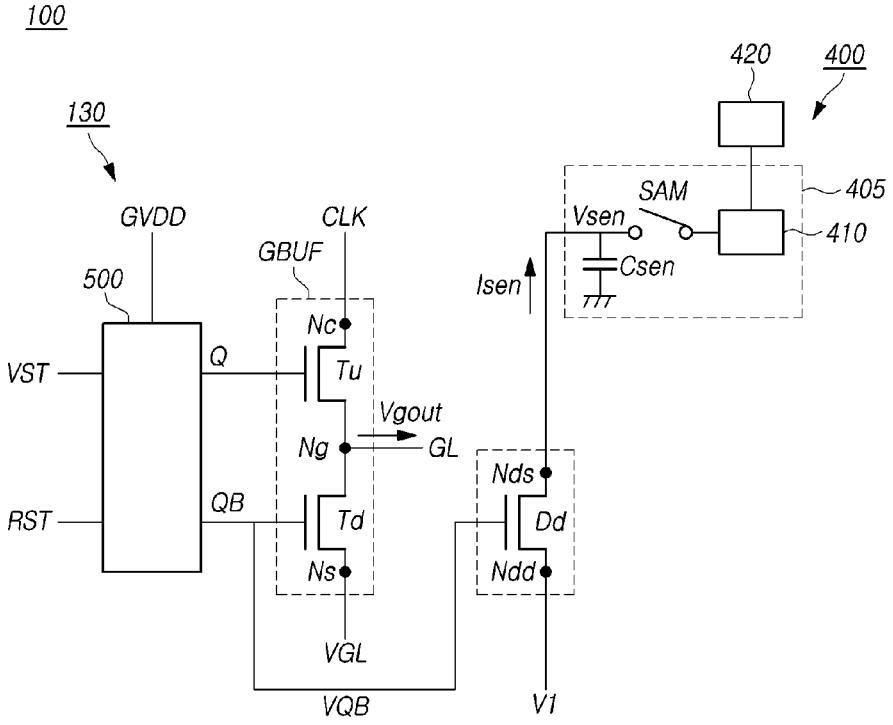
FIG. 3 illustrates a circuit configuration of the display device shown in FIG. 2 according to aspects of the present disclosure.

FIG. 3 illustrates a circuit configuration of the display device shown in FIG. 2 according to aspects of the present disclosure.

Referring to FIG. 3, the gate driving circuit 130 of the display device 100 can generate and output a gate signal Vgout based on a clock signal CLK. The gate signal Vgout may be supplied to gate lines GL disposed in the display panel 110.

The gate driving circuit 130 can include a gate output buffer circuit GBUF that outputs the gate signal Vgout based on the clock signal CLK, a control circuit 500 that controls the gate output buffer circuit GBUF, and the like.

The gate output buffer circuit GBUF can include a pull-up transistor Tu that controls a connection between a clock input node Nc to which the clock signal CLK is input and a gate output node Ng from which the gate signal Vgout is output, and a pull-down transistor Td that controls a connection between the gate output node Ng and a low level voltage node Ns to which a low level voltage VGL is input.

The control circuit 500 can receive a start signal VST, a reset signal RST, and the like, and thereby, control the operation of the gate output buffer circuit GBUF. To do this, the control circuit 500 can control a voltage of node Q and a voltage VQB of node QB. The control circuit 500 can control the voltage VQB of node QB through a DC power supply voltage GVDD.

The gate driving circuit 130 can further include a transistor vulnerable to reliability, for example, a dummy pull-down transistor Dd on which the same stress as the pull-down transistor Td is put.

A gate node of the dummy pull-down transistor Dd may be electrically connected to a gate node of the pull-down transistor Td. That is, both the respective gate nodes of the pull-down transistor Td and the dummy pull-down transistor Dd may be electrically connected to one node, i.e., node QB.

A structure, material, type, and/or the like of the dummy pull-down transistor Dd may have the same or substantially the same as a structure, material, type, and/or the like of the pull-down transistor Td; however, embodiments of the present disclosure are not limited thereto.

As a first power supply voltage V1 is applied to a drain node Ndd of the dummy pull-down transistor Dd, a current flowing through a source node Nds of the dummy pull-down transistor Dd or a voltage related to the current can be sensed. The drain node Ndd and the source node Nds of the dummy pull-down transistor Dd may be located oppositely according to a type of the transistor.

The display device 100 according to aspects of the present disclosure can further include a compensation circuit 400 capable of sensing a current Isen flowing through the source node Nds of the dummy pull-down transistor Dd or a voltage Vsen by the current Isen to compensate for a power supply voltage, and capable of compensating for the power supply voltage according to the sensed current Isen or voltage Vsen.

The compensation circuit 400 can include a sensing processing circuit 405 capable of sensing a current Isen flowing through the source node Nds of the dummy pull-down transistor Dd or a voltage Vsen by the current Isen to compensate for a power supply voltage, and a control device 420 capable of compensating for the power supply voltage according to the sensed current or voltage.

For example, as shown in FIG. 3, the sensing processing circuit 405 can include a sampling switch SAM, an analog-to-digital converter 410, and a sensing capacitor Csen.

The sampling switch SAM may be disposed between the analog-to-digital converter 410 and the source node Nds of the dummy pull-down transistor Dd. The sampling switch SAM can control an electrical connection between the analog-to-digital converter 410 and the source node Nds of the dummy pull-down transistor Dd.

The analog-to-digital converter 410 can sense a sensing voltage Vsen stored in the sensing capacitor Csen by a sensing current Isen flowing through the source node Nds of the dummy pull-down transistor Dd electrically connected by the sampling switch SAM.

For example, the sensing capacitor Csen may be connected between the source node Nds of the dummy pull-down transistor Dd and a ground voltage GND. The sensing capacitor Csen can store a voltage by the sensing current Isen as the sensing voltage Vsen. When the sensing capacitor Csen is electrically connected to the analog-to-digital converter 410 by the sampling switch SAM, the analog-to-digital converter 410 can sense the sensing voltage Vsen.

The analog-to-digital converter 410 can convert the sensing voltage Vsen into sensing data in a digital form, and output the sensing data resulting from the conversion to the control device 420.

The control device 420 can determine a voltage value of a power supply voltage GVDD of the gate driving circuit 130 according to lifetime dispersion or an expected lifetime of the pull-down transistor Td of the gate driving circuit 130 based on the sensing data.

Figure 4:
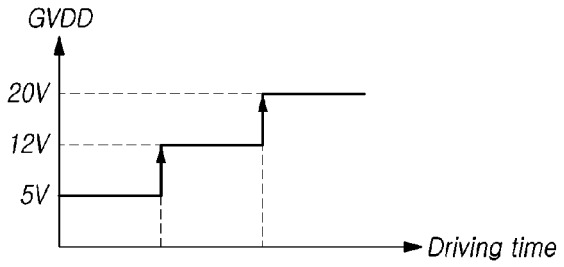
FIG. 4 illustrates a power supply voltage applied to a control circuit of FIG. 3 varies according to a driving time.

As shown in FIG. 4, a power supply voltage GVDD applied to the control circuit 500 of the gate driving circuit 130 can be controlled to gradually increase from a low voltage to a high voltage according to a driving time.

For example, in an example typical display panel, a gate driving circuit is controlled based on alternating current (AC) and has two output buffer circuits GBUF for each control circuit 500. In this case, when a direct current (DC) power supply voltage GVDD of the gate driving circuit 130 corresponding to a relative high voltage is continuously applied to the control circuit 500, since the lifetime of the pull-down transistor Td can be shortened quickly, the control circuit 500 is alternately driven based on AC.

In this situation, for allowing the control circuit 500 to be alternately driven based on AC, as two output buffer circuits GBUF for each control circuit 500 are configured, the number of transistors included in the gate driving circuit 130 may increase, and the complexity of corresponding circuitry or circuit elements configured in the gate driving circuit may increase. As the number of transistors included in the gate driving circuit 130 increases and the complexity of corresponding circuitry or circuit elements increases, the defect rate of the gate driving circuit 130 may increase, and it becomes difficult to implement a narrow bezel.

The gate driving circuit 130 included in the display device 100 can apply a DC voltage as the power supply voltage GVDD to the control circuit 500, and to maximize the lifetime of the pull-down transistor Td, compensate for the power supply voltage GVDD of the control circuit 500 using a voltage value in the range from a low voltage (e.g., 5V) to a high voltage (e.g., 12V or 20V) according to a driving time as shown in FIG. 4, taking account of a degree to which stress is put on the pulled-down transistor Td. Thus, as the power supply voltage GVDD of the control circuit 500 is compensated using a voltage value in the range from the low voltage (e.g., 5V) to the high voltage (e.g., 12V or 20V) according to a driving time as shown in FIG. 4, the stress of the pull-down transistor Td can be adjusted, resulting in the lifetime of the pull-down transistor Td to be increased or be maximized.

More specifically, in the display device 100 according to aspects of the present disclosure, by adding the dummy pull-down transistor Dd in the gate driving circuit 130 and configuring the dummy pull-down transistor Dd such that the same stress as the pull-down transistor Td of the output buffer circuit GBUF is put on the dummy pull-down transistor Dd, it is possible to sense a sensing current Isen or a sensing voltage Vsen by the dummy pull-down transistor Dd.

The display device 100 can calculate lifetime dispersion and an expected lifetime of the pull-down transistor Td of the output buffer circuit GBUF by the control device 420 based on the sensing current Isen or the sensing voltage Vsen obtained by the sensing, and thereby compensate for a power supply voltage GVDD applied to the control circuit 500 of the gate driving circuit 130. According to embodiments of the present disclosure, when a power supply voltage GVDD applied to the control circuit 500 of the gate driving circuit 130 gradually increases from the low voltage to the high voltage, the lifetime of the pull-down transistor Td can be improved.

In the display device 100 according to aspects of the present disclosure, the number of transistors included in the gate driving circuit 130 can be reduced, and the complexity of corresponding circuitry or circuit elements configured in the gate driving circuit can be reduced. Accordingly, in the display device 100 according to aspects of the present disclosure, the defect rate of the gate driving circuit 130 can be reduced, and a narrow bezel can be implemented.

In the above description according to embodiments of the present disclosure, although discussions on the display device 100 have been conducted in which a DC voltage as the power supply voltage GVDD is applied to the control circuit 500 of the gate driving circuit 130, and the DC power supply voltage GVDD applied to the control circuit 500 is compensated for according to a driving time, but embodiments of the present disclosure are not limited thereto. For example, in the display device 100 according to aspects of the present disclosure, a power supply voltage GVDD applied to the control circuit 500 of the gate driving circuit 130 may be an AC voltage in which a low voltage and a high voltage alternate, and the low voltage or the high voltage of the AC power supply voltage GVDD applied to the control circuit 500 can be compensated for according to a driving time.

In the above description according to embodiments of the present disclosure, although discussions on the display device 100 have been conducted in which the analog-to-digital converter 410 can sense a sensing voltage Vsen stored in the sensing capacitor Csen by a sensing current Isen flowing through the source node Nds of the dummy pull-down transistor Dd, embodiments of the present disclosure are not limited thereto. For example, in the display device 100 according to aspects of the present disclosure, an impedance circuit such as a sensing resistor instead of the sensing capacitor Csen may be configured, and then, the analog-to-digital converter 410 can sense a voltage formed by the impedance circuit.

Further, the analog-to-digital converter 410 can directly sense a sensing current Isen flowing through the source node Nds of the dummy pull-down transistor Dd, and can convert the sensing current Isen into sensing data in a digital form.

In some embodiments, the control device 420 of the compensation circuit 400 may be implemented in a separate component, or may be implemented by the controller 140 of FIG. 1 as described below with reference to FIG. 5. That is, the compensation circuit 400 can include the sensing processing circuit 405 capable of sensing a current flowing through the source node Nds of the dummy pull-down transistor Dd or a voltage by the current, and the controller 140 capable of compensating for a power supply voltage according to the sensed current or voltage.

Figure 5:
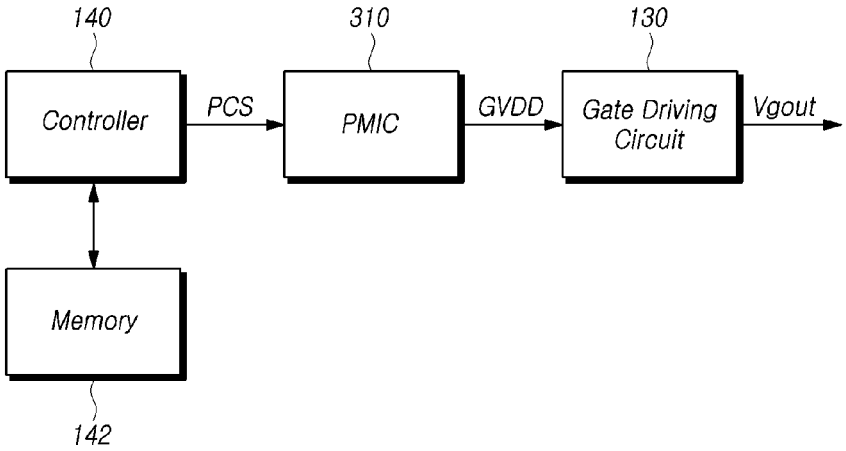
FIG. 5 is a block diagram illustrating an example of implementing a control device of a compensation circuit of FIG. 3 using a controller of FIG. 1.

FIG. 5 is a block diagram illustrating an example of implementing the control device of the compensation circuit of FIG. 3 using the controller of FIG. 1.

Referring to FIG. 5, the controller 140 can perform various calculation functions and control functions based on sensing data output from the analog-to-digital converter 410.

The controller 140 can calculate lifetime dispersion and an expected lifetime of the pull-down transistor Td based on the sensing data output from the analog-to-digital converter 410. The controller 140 can determine a power supply voltage GVDD based on the calculated lifetime dispersion and the expected lifetime of the pull-down transistor Td.

The controller 140 can store the sensing data output from the analog-to-digital converter 410 or store various types of control information in a memory 142. The controller 140 can store control information related to the compensation of the power supply voltage in the memory 142 in the form of a look-up table LUT.

The controller 140 can output a power control signal PCS for the compensation of the power supply voltage to a power management integrated circuit 310.

The power management integrated circuit 310 can supply a power supply voltage GVDD to the control circuit 500 of the gate driving circuit 130 according to the power control signal PCS for compensating for the power supply voltage, or cause a power circuitry (not shown) to supply the power supply voltage GVDD.

In some embodiments, the sensing processing circuit 405 may be implemented in a separate component, or may be included in the data driving circuit 120 of FIG. 1. For example, the sensing processing circuit 405 may be included in a source driver integrated circuit SDIC of the data driving circuit 120 of FIG. 1.

Figure 6A:
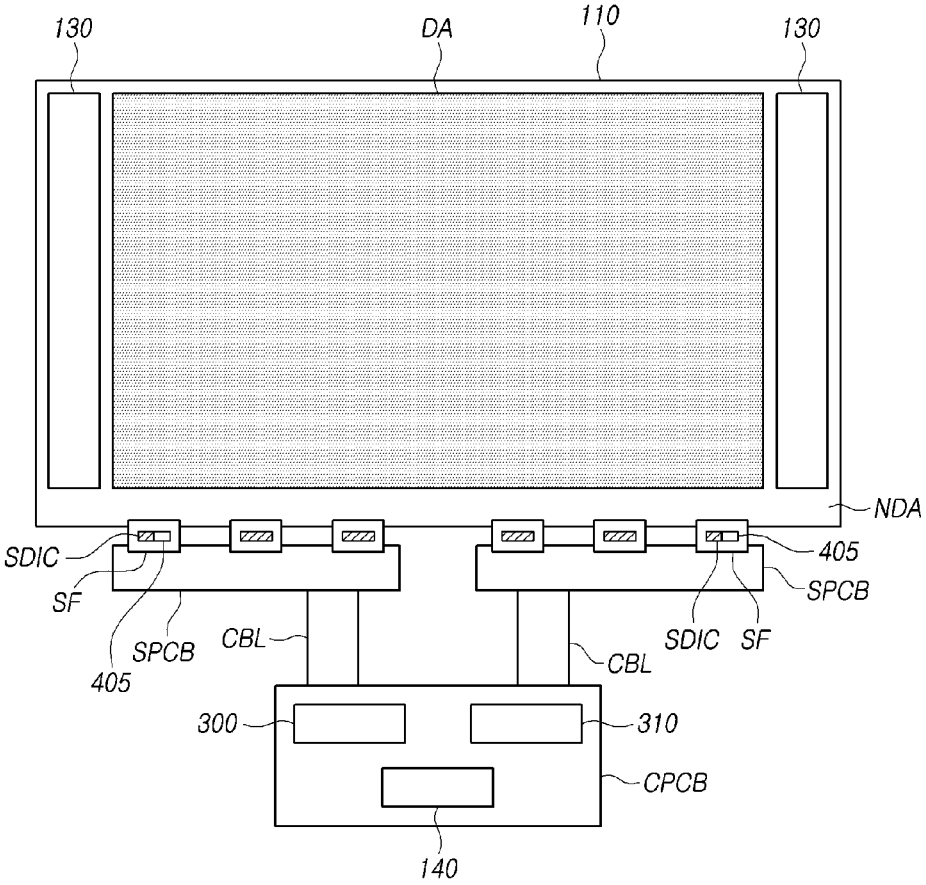
FIG. 6A illustrates a sensing processing circuit included in a source driver integrated circuit of a data driving circuit adjacent to a gate driving circuit.

The sensing processing circuit 405 may be included in a source driver integrated circuit SDIC of the data driving circuit 120 adjacent to the gate driving circuit 130 as shown in FIG. 6A.

As described above, the gate driving circuit 130 may be located on, but not limited to, two portions (e.g., a left side and a right side) of the panel 110 or at least two of four portions (e.g., an upper portion, a lower portion, the left side, and the right side) of the panel 110. In this embodiment, the sensing processing circuit 405 may be included in source driver integrated circuits SDIC respectively located on both portions (the left and right sides) of the display panel 110.

When the gate driving circuit 130 is located on one portion (the left or right side) of the display panel 110, the sensing processing circuit 405 may be included in a source driver integrated circuit SDIC of a data driving circuit 120 disposed on one portion (the left or right side) adjacent to the gate driving circuit 130.

Figure 6B:
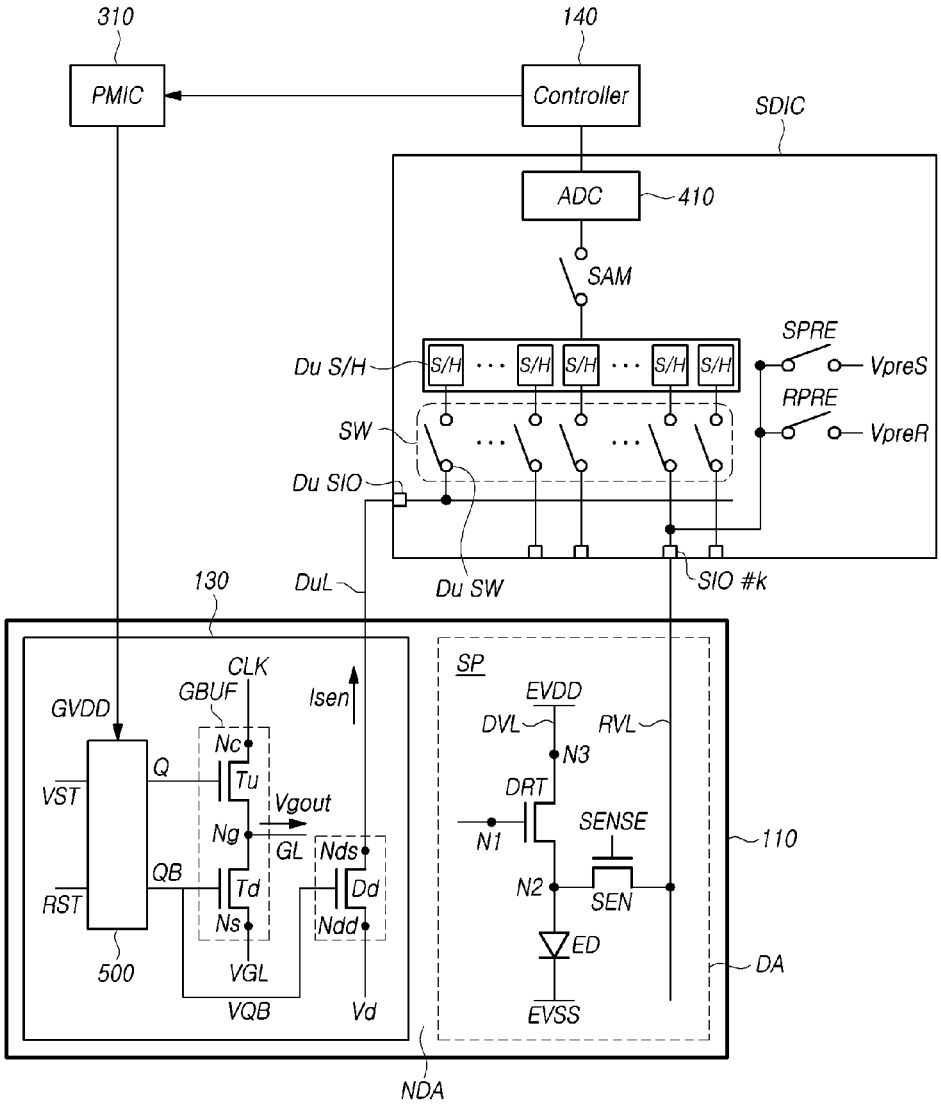
FIG. 6B illustrates a circuit configuration in which the control device of the compensation circuit of FIG. 3 is implemented using the controller of FIG. 1, and a sensing processing circuit of the compensation circuit of FIG. 3 is included in a source driver integrated circuit of a data driving circuit of FIG. 1.

FIG. 6B illustrates a circuit configuration in which the control device of the compensation circuit of FIG. 3 is implemented by the controller of FIG. 1, and the sensing processing circuit of the compensation circuit of FIG. 3 is included in a source driver integrated circuit SDIC of the data driving circuit 120 of FIG. 1.

Referring to FIG. 6B, the display device 100 can include the data driving circuit 120 described with reference to FIG. 1, the gate driving circuit 130 described with reference to FIG. 3, the controller 140 described with reference to FIG. 5, and a plurality of sub-pixels SP.

The source driver integrated circuit SDIC of the data driving circuit 120 can include at least one selection switch SW, at least one sample and hold S/H, a sampling switch SAM, and an analog-to-digital converter 410.

Each of the plurality of sub-pixels SP disposed in the display panel 110 of the display device 100 can include a light emitting element ED, a driving transistor DRT, and a sensing transistor SEN.

A first node N1 of the driving transistor DRT may be a gate node of the driving transistor DRT. A second node N2 of the driving transistor DRT may be a source node or a drain node of the driving transistor DRT. The second node N2 may be also electrically connected to a source node or a drain node of the sensing transistor SEN, and electrically connected to the light emitting element ED. A third node N3 of the driving transistor DRT may be electrically connected to a driving voltage line DVL for supplying a driving voltage EVDD.

The sensing transistor SEN can be turned on by a sense signal SENSE, and pass one of reference voltages VpreS and VpreR transmitted through the reference voltage line RVL to the second node N2 of driving transistor DRT. The reference voltages VpreS and VpreR may be selected by two switches SPRE and RPRE.

Further, the sensing transistor SEN can be turned on by the sense signal SENSE, and transmit a voltage at the second node N2 of the driving transistor DRT to the reference voltage line RVL.

In this case, the voltage at the second node N2 of the driving transistor DRT transmitted to the reference voltage line RVL may be a voltage for calculating at least one characteristic value of the sub-pixel SP or a voltage in which the at least one characteristic value of the sub-pixel SP is reflected. For example, the at least one characteristic value of the sub-pixel SP may be at least one characteristic value of the driving transistor DRT or the light emitting element ED. The at least one characteristic value of the driving transistor DRT may include a threshold voltage and/or mobility of the driving transistor DRT. The characteristic value of the light emitting element ED may include a threshold voltage of the light emitting element ED.

The reference voltage line RVL may be electrically connected to selection switches SW, two or more sample and holds S/H, the sampling switch SAM, and the analog-to-digital converter 410 through data pads (SIO #k, here, k indicates a number of a reference voltage line RVL corresponding to a sub-pixel SP).

A dummy line DuL extending from the source node Nds of the dummy pull-down transistor Dd of the gate driving circuit 130 as described above may be electrically connected to at least one selection switch SW, at least one sample and hold S/H, the sampling switch SAM, and the analog-to-digital converter 410 through a dummy pad Du SIO.

The selection switches SW can select one of the dummy pad Du SIO and two or more data pads SIO #k. For example, the selection switches SW may select two or more data pads SIO #k during a display driving period, and may select the dummy pad Du SIO during a blank period.

The sample and holds S/H can respectively temporarily store voltages at the second nodes N2 of driving transistors DRT transmitted through reference voltage lines RVL connected through the data pads SIO #k and a sensing voltage Vsen of the dummy pull-down transistor Dd sensed through the dummy line DuL.

The sampling switch SAM can sequentially connect the sample and holds S/H to the analog-to-digital converter 410.

That is, the source driver integrated circuit SDIC of the data driving circuit 120 can further include the dummy pad Du SIO, the selection switch Du SW, and the sample & hold Du S/H needed for sensing a sensing voltage Vsen of the dummy pull-down transistor Dd, in addition to the data pads SIO #k, the selection switches SW, and the sample and holds S/H needed for sensing a voltage at the second node N2 of the driving transistor DRT.

The dummy pad Du SIO, the selection switch Du SW, the sample and hold Du S/H, and the analog-to-digital converter 410 may correspond to the sensing processing circuit 405 described with reference to FIG. 3.

The analog-to-digital converter 410 can sense a voltage at the second node N2 of the driving transistor DRT and a sensing voltage Vsen of the dummy pull-down transistor Dd according to a selection of the sampling switch SAM.

Respective times at which the analog-to-digital converter 410 senses a voltage at the second node N2 of at least one driving transistor DRT and a sensing voltage Vsen of the dummy pull-down transistor Dd may be the same or different.

In one embodiment, the analog-to-digital converter 410 can sense a voltage at the second node N2 of at least one driving transistor DRT during a display driving period, and a sensing voltage Vsen of the dummy pull-down transistor Dd during a blank period. In another embodiment, the analog-to-digital converter 410 can sense a voltage at the second node N2 of the driving transistor DRT and a sensing voltage Vsen of the dummy pull-down transistor Dd during respective sub-blank periods resulting from dividing the blank period.

The source driver integrated circuit SDIC of data driving circuit 120 can transmit respective sensing data corresponding to the voltage at the second node N2 of the driving transistor DRT and the sensing voltage Vsen of the dummy pull-down transistor Dd to the controller 140.

The controller 140 can determine a voltage value of a power supply voltage GVDD of the gate driving circuit 130 according to lifetime dispersion and an expected lifetime of the pull-down transistor Td of the gate driving circuit 130 in the form of a lookup table as shown in FIG. 5 based on the sensing data corresponding to the sensing voltage Vsen of the dummy pull-down transistor Dd.

The controller 140 can control a voltage to be output from the power management integrated circuit 310, and thereafter, a power supply voltage GVDD output from the power management integrated circuit 310 may gradually increase from a low voltage to a high voltage according to a driving time.

Figure 7:
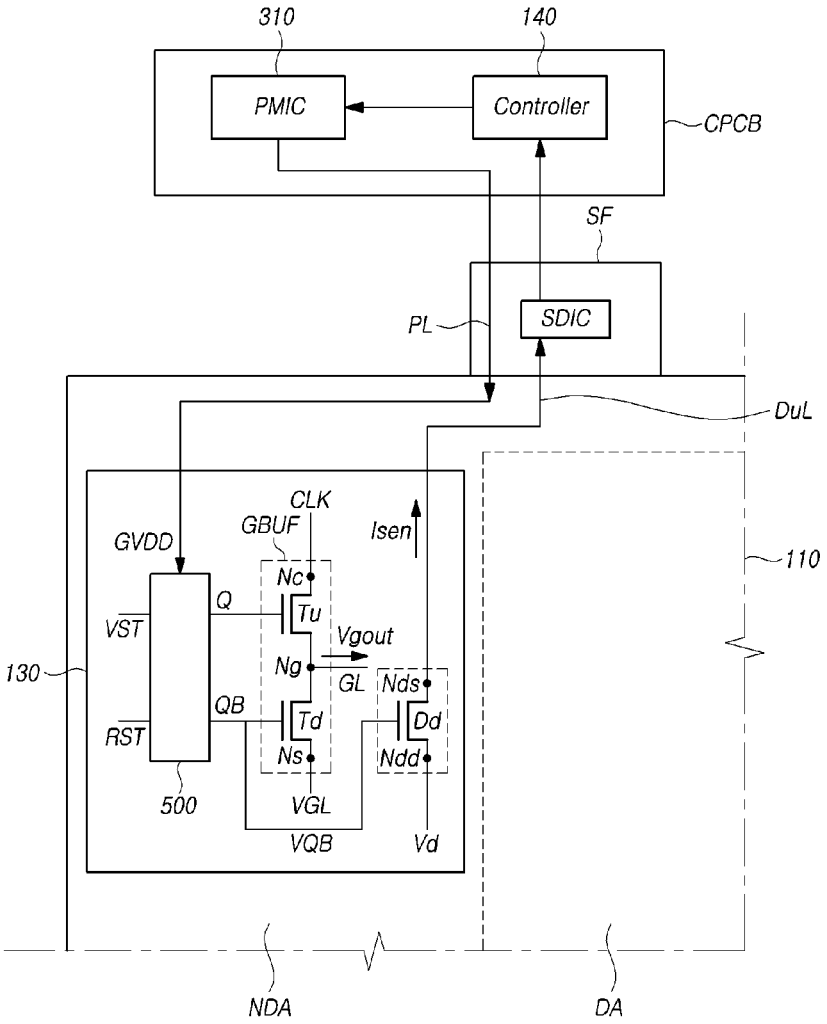
FIG. 7 illustrates a connection state between a power management integrated circuit located on a control printed circuit board and a control circuit of the gate driving circuit.

As shown in FIG. 7, the power management integrated circuit 310 located on a control printed circuit board CPCB can transmit the power supply voltage GVDD to the control circuit 500 of the gate driving circuit 130 through a circuit film SF and a power line PL located in the non-display area NDA of the display panel 110.

In the above description according to embodiments of the present disclosure, although discussions on the display device 100 have been conducted in which the sensing processing circuit 405 of the compensation circuit 400 is included in the data driving circuit 120 (e.g., in an SDIC of the data driving circuit 120), and the control device 420 of the compensation circuit 400 is implemented by the controller 140 of FIG. 1, embodiments of the present disclosure are not limited thereto.

Figure 8:
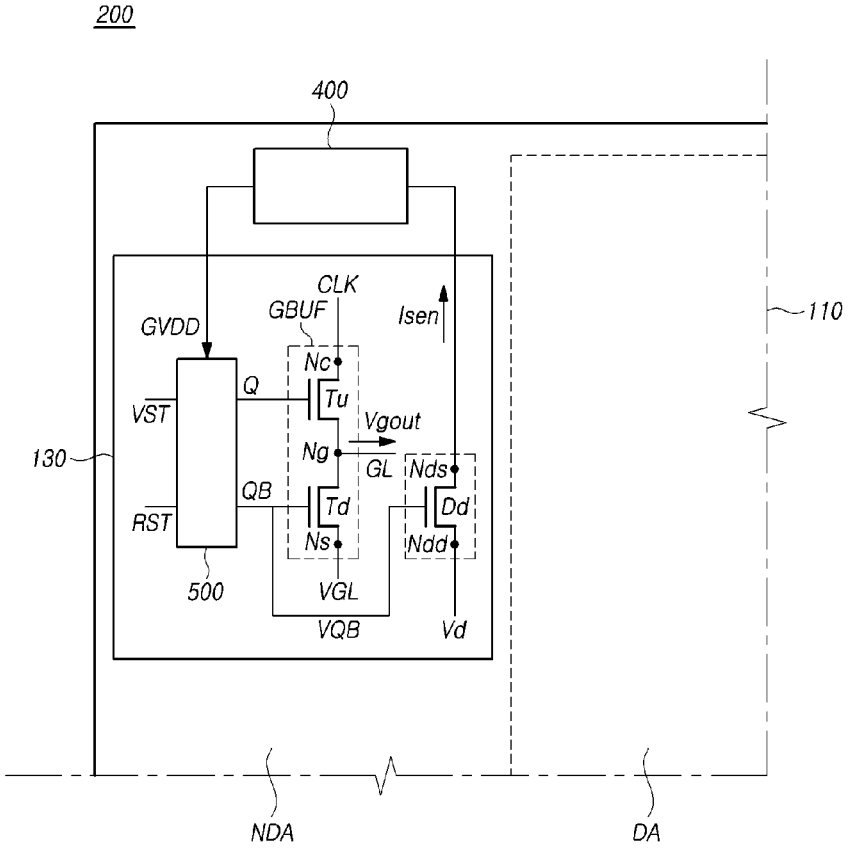
FIG. 8 illustrates a system configuration of the display device according to aspects of the present disclosure.
Figure 9:
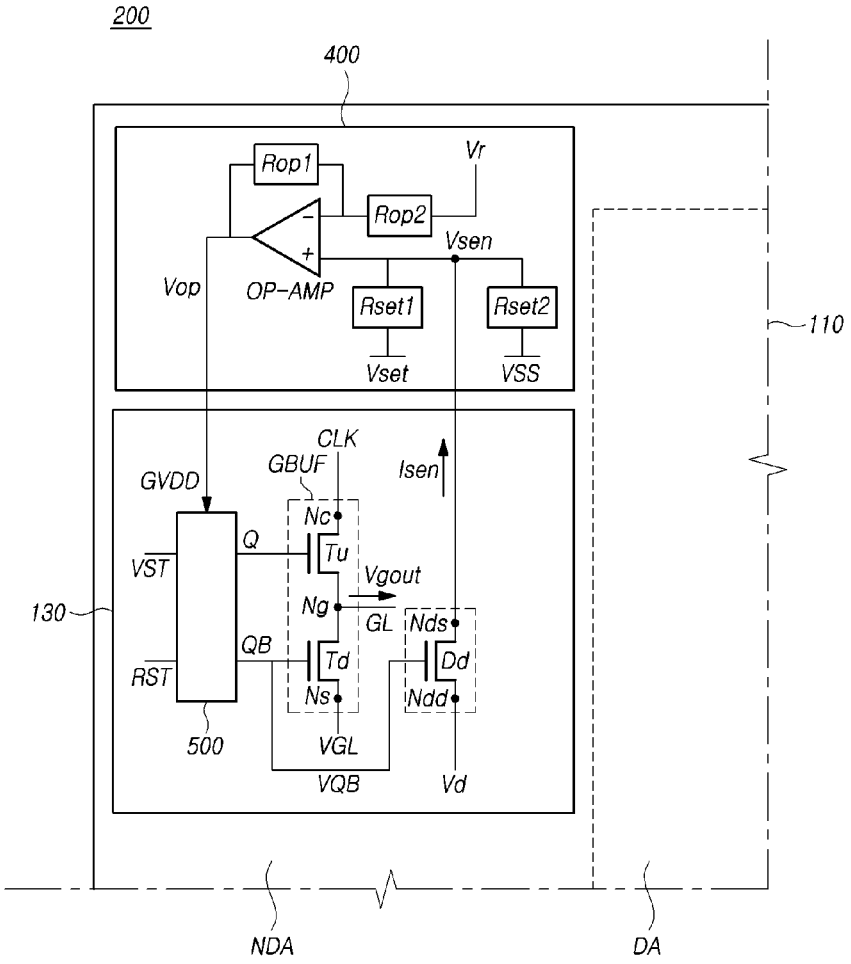
FIG. 9 illustrates a circuit configuration of the display device shown in FIG. 8.

FIG. 8 illustrates a system configuration of the display device according to aspects of the present disclosure. FIG. 9 illustrates a circuit configuration of the display device shown in FIG. 8.

Referring to FIG. 8, a display device 200 according to aspects of the present disclosure can include a gate driving circuit 130 including a compensation circuit 400 capable of sensing a stress level through a dummy pull-down transistor Dd, that is, a degree to which stress is put on the dummy pull-down transistor Dd.

Referring to FIG. 9, the compensation circuit 400 may have a differential amplifier structure including an operational amplifier OP-AMP, sensing resistors Rset1 and Rset2 for enabling a sensing voltage Vsen to be applied to a non-inverting input terminal (+) of the operational amplifier OP-AMP, and input resistors Rop1 and Rop2 for enabling a reference voltage Vr to be applied to an inverting input terminal (−) of the operational amplifier OP-AMP.

The sensing resistor Rset1 of the sensing resistors Rset1 and Rset2 may be disposed between a set voltage Vset and the non-inverting input terminal (+). The other sensing resistor Rset2 may be disposed between a base voltage VSS and the non-inverting input terminal (+). For example, the set voltage Vset may be 15V, and the base voltage VSS may be 0V.

The input resistor Rop2 of the input resistors Rop1 and Rop2 may be disposed between the reference voltage Vr and the inverting input terminal (−), and the input resistor Rop1 may be disposed between the inverting input terminal (−) and an output terminal of the operational amplifier OP-AMP.

The operational amplifier OP-AMP can receive a difference (variation amount) of a sensing voltage Vsen obtained through sensing relative to an initial reference voltage Vr via the input terminals, and can generate a power supply voltage GVDD resulting from increasing an output voltage Vop further as the difference (variation amount) increases.

As described above, according to the embodiments described herein, it is possible to provide the gate driving circuit 130 and the display devices 100 and 200 including the gate driving circuit 130 where the number of transistors included in the gate driving circuit 130 can be reduced, and the complexity of circuitry or circuit elements configured in the gate driving circuit 130 can be reduced.

According to the embodiments described herein, it is possible to provide the gate driving circuit 130 and the display devices 100 and 200 including the gate driving circuit 130 where the defect rate of the gate driving circuit can be reduced and a narrow bezel can be implemented.

According to the embodiments described herein, it is possible to provide the gate driving circuit 130 and the display devices 100 and 200 including the gate driving circuit 130 where the lifetime of a transistor such as a pull-down transistor Td included in the gate driving circuit can be maximized or increased by adjusting the stress of the transistor.

The above description has been presented to enable any person skilled in the art to make and use the technical idea of the present invention, and has been provided in the context of a particular application and its requirements. Various modifications, additions and substitutions to the described embodiments will be readily apparent to those skilled in the art, and the general principles defined herein may be applied to other embodiments and applications without departing from the spirit and scope of the present invention. The above description and the accompanying drawings provide an example of the technical idea of the present invention for illustrative purposes only. That is, the disclosed embodiments are intended to illustrate the scope of the technical idea of the present invention. Thus, the scope of the present invention is not limited to the embodiments shown, but is to be accorded the widest scope consistent with the claims. The scope of protection of the present invention should be construed based on the following claims, and all technical ideas within the scope of equivalents thereof should be construed as being included within the scope of the present invention.

What is claimed is:

1. A display device comprising:

a display panel including at least one sub-pixel; and a gate driving circuit configured to supply a gate signal to the at least one sub-pixel through at least one gate line, wherein the gate driving circuit comprises:

a gate output buffer circuit including a pull-up transistor that controls a connection between a clock input node and a gate output node, and a pull-down transistor that controls a connection between a low level voltage node and the gate output node;

a control circuit configured to control the gate output buffer circuit; and a dummy pull-down transistor whose gate node is shared with a gate node of the pull-down transistor, and wherein a first power supply voltage is applied to one of source and drains nodes of the dummy pull-down transistor for enabling a current flowing through the other of the source and drains nodes thereof or a voltage by the current to be sensed, wherein the display device further comprises a compensation circuit configured to sense the current flowing through the other of the source and drain nodes of the dummy pull-down transistor or the voltage by the current, and to compensate for a second power supply voltage applied to the control circuit according to the sensed current or voltage, and wherein the compensation circuit comprises:

a sensing processing circuit configured to sense the current flowing through the source node of the dummy pull-down transistor or the voltage by the current; and a control device configured to compensate for the second power supply voltage according to the sensed current or voltage.

2. The display device according to claim 1, wherein a second power supply voltage applied to the control circuit is direct current (DC), and the DC power supply voltage applied to the control circuit is compensated for according to a driving time.

3. The display device according to claim 1, wherein the sensing processing circuit comprises:

a sensing capacitor storing a sensing voltage according to the current flowing through the source node of the dummy pull-down transistor, an analog-to-digital converter configured to convert the sensing voltage stored in the sensing capacitor into sensing data in a digital form; and a sampling switch configured to control an electrical connection between the sensing capacitor and the analog-to-digital converter.

4. The display device according to claim 1, further comprising a controller for controlling the gate driving circuit, wherein the control device is implemented by the controller.

5. The display device according to claim 1, further comprising a data driving circuit including one or more source driver integrated circuits each configured to output at least one data signal to at least one data line, wherein the compensation circuit comprises:

a sensing processing circuit configured to sense the current flowing through the source node of the dummy pull-down transistor or the voltage by the current; and a control device configured to compensate for the second power supply voltage according to the sensed current or voltage, and wherein the sensing processing circuit is included in at least one of the one or more source driver integrated circuits.

6. The display device according to claim 5, wherein the at least one source driver integrated circuits in which the sensing processing circuit is included is located adjacent to one side of the display panel on which the gate driving circuit is located.

7. The display device according to claim 1, further comprising a data driving circuit including one or more source driver integrated circuits each configured to output at least one data signal to at least one data line, wherein the at least one sub-pixel comprises:

at least one driving transistor; and at least one reference voltage line electrically connected to a specific node of the at least one driving transistor, and wherein the one or more source driver integrated circuits comprises:

selection switches selecting the at least one reference voltage line and a dummy line electrically connected with the dummy pull-down transistor;

sample and holds respectively electrically connected with the selection switches, and configured to store a voltage at the specific node of the at least one driving transistor transmitted through the at least one reference voltage line and a sensing voltage of the dummy pull-down transistor sensed through the dummy line;

an analog-to-digital converter configured to convert the voltage at the specific node of the at least one driving transistor transmitted through the at least one reference voltage line and the sensing voltage of the dummy pull-down transistor sensed through the dummy line, which are stored in the sample and holds, into sensing data in a digital form; and a sampling switch configured to electrically connect the sample and holds with the analog-to-digital converter.

8. The display device according to claim 1, wherein the compensation circuit is included in the gate driving circuit.

9. A gate driving circuit comprising:

a gate output buffer circuit including a pull-up transistor that controls a connection between a clock input node and a gate output node, and a pull-down transistor that controls a connection between a low level voltage node and the gate output node;

a control circuit capable of controlling the gate output buffer circuit; and a dummy pull-down transistor whose gate node is shared with a gate node of the pull-down transistor, wherein a first power supply voltage is applied to one of source and drains nodes of the dummy pull-down transistor for enabling a current flowing through the other of the source and drains nodes thereof or a voltage by the current to be sensed, wherein the gate driving circuit further comprises a compensation circuit configured to sense the current flowing through the other of the source and drain nodes of the dummy pull-down transistor or the voltage by the current, and to compensate for a second power supply voltage according to the sensed current or voltage, and wherein the compensation circuit comprises:

a sensing processing circuit configured to sense the current flowing through the source node of the dummy pull-down transistor or the voltage by the current; and a control device configured to compensate for the second power supply voltage according to the sensed current or voltage.

10. The gate driving circuit according to claim 9, wherein a second power supply voltage applied to the control circuit is direct current (DC), and the DC power supply voltage applied to the control circuit is compensated for according to a driving time.

11. The gate driving circuit according to claim 9, wherein the sensing processing circuit comprising:

a sensing capacitor storing a sensing voltage according to the current flowing through the source node of the dummy pull-down transistor, an analog-to-digital converter configured to convert the sensing voltage stored in the sensing capacitor into sensing data in a digital form; and a sampling switch configured to control an electrical connection between the sensing capacitor and the analog-to-digital converter.

12. The gate driving circuit according to claim 9, wherein the compensation circuit is included in the gate driving circuit.

13. A display device comprising:

a display panel including at least one sub-pixel; and a gate driving circuit configured to supply a gate signal to the at least one sub-pixel through at least one gate line, wherein the gate driving circuit comprises:

a gate output buffer circuit configured to output the gate signal to the at least one gate line, the gate output buffer including:

a pull-up transistor configured to output a clock signal as the gate signal to the at least one gate line when the pull-up transistor is turned on;

a pull-down transistor configured to output a low level voltage to the at least one gate line when the pull-down transistor is turned on; and a dummy pull-down transistor, the dummy pull-down transistor turned on while the pull-down transistor is turned on, and the dummy pull-down transistor turned off while the pull-down transistor is turned off.

14. The display device according to claim 13, further comprising:

a control circuit configured to control the gate output buffer circuit; and a compensation circuit configured to sense a current flowing through the dummy pull-down transistor, wherein a DC (direct current) power supply voltage compensated according to the sensed current is applied to the control circuit.

15. The display device according to claim 13, wherein the DC power supply voltage at a first driving time of the pull-down transistor is smaller than the DC power supply voltage at a second driving time of the pull-down transistor greater than the first driving time.

16. The display device according to claim 13, wherein the pull-down transistor and the dummy pull-down transistor are turned on or off according to a common control signal from the control circuit.

* * * * *